US012522966B2

(12) United States Patent
Barreau et al.

(10) Patent No.: US 12,522,966 B2
(45) Date of Patent: Jan. 13, 2026

(54) DRUM FOR A WASHING MACHINE, COMPRISING AT LEAST ONE PARALLELEPIPED-SHAPED COMPARTMENT, AND WASHING MACHINE COMPRISING SAME

(71) Applicants: Denis Barreau, Mezieres-sur-Sein (FR); Kévin Wolak, La Selle-Saint-Cloud (FR)

(72) Inventors: Denis Barreau, Mezieres-sur-Sein (FR); Kévin Wolak, La Selle-Saint-Cloud (FR)

( * ) Notice: Subject to any disclaimer, the term of this patent is extended or adjusted under 35 U.S.C. 154(b) by 223 days.

(21) Appl. No.: 17/263,509

(22) PCT Filed: Jul. 26, 2019

(86) PCT No.: PCT/FR2019/051854

§ 371 (c)(1),
(2) Date: Apr. 26, 2021

(87) PCT Pub. No.: WO2020/021210

PCT Pub. Date: Jan. 30, 2020

(65) Prior Publication Data

US 2022/0145515 A1 May 12, 2022

(30) Foreign Application Priority Data

Jul. 26, 2018 (FR) ..... 1856959

(51) Int. Cl.

| | |
|---|---|
| ***D06F 37/08*** | (2006.01) |
| ***D06F 23/02*** | (2006.01) |
| ***D06F 95/00*** | (2006.01) |

(52) U.S. Cl.

CPC ..... *D06F 37/08* (2013.01); *D06F 23/02* (2013.01); *D06F 95/00* (2013.01)

(58) Field of Classification Search

CPC ..... D06F 23/02; D06F 37/08; D06F 95/00
See application file for complete search history.

(56) References Cited

U.S. PATENT DOCUMENTS

| | | | | |
|---|---|---|---|---|
| 1,762,665 A | | 6/1930 | Paris | |
| 3,736,774 A | * | 6/1973 | Shibata | D06F 9/00 15/3.2 |
| 3,924,425 A | * | 12/1975 | Arendt | B30B 9/22 68/242 |
| 4,109,397 A | * | 8/1978 | Daily | D06F 58/04 34/239 |

(Continued)

FOREIGN PATENT DOCUMENTS

| | | |
|---|---|---|
| DE | 1207328 | 7/1966 |
| DE | 4108536 | 5/2000 |

(Continued)

OTHER PUBLICATIONS

Machine translation of JP-5263794-B2. (Year: 2013).*

(Continued)

*Primary Examiner* — Joseph L. Perrin
(74) *Attorney, Agent, or Firm* — TraskBritt

(57) ABSTRACT

A drum for a washing machine for washing and/or spin drying mattresses, the drum being able to rotate about a substantially horizontal axis and comprising at least one parallelepiped-shaped compartment. The at least one parallelepipedal compartment is configured to contain one or more mattresses therein, wherein the one or more mattresses having length and width dimensions between 70×140 cm and 200×200 cm, respectively, a thickness between 3 and 40 cm, and a weight ranging from 5 to 70 kg. The drum has an open face allowing the insertion and removal of the one or more mattresses from the drum. The open face is located at an axial end of the drum.

18 Claims, 5 Drawing Sheets

(56) References Cited

U.S. PATENT DOCUMENTS

| | | | | |
|---|---|---|---|---|
| 5,907,961 | A * | 6/1999 | Lee | D06B 3/30 68/152 |
| 10,190,248 | B2 * | 1/2019 | Rhode | D06F 34/05 |
| 2002/0092329 | A1 * | 7/2002 | Rhode | D06F 95/006 68/152 |
| 2004/0089030 | A1 * | 5/2004 | Rhode | D06F 37/08 68/152 |
| 2011/0030148 | A1 * | 2/2011 | Saubert | D06F 37/04 8/137 |
| 2012/0291497 | A1 * | 11/2012 | Scarafiotti | D06F 37/08 68/139 |
| 2017/0260677 | A1 * | 9/2017 | Capovilla | B08B 3/047 |
| 2020/0141042 | A1 * | 5/2020 | Cho | D06F 34/18 |

FOREIGN PATENT DOCUMENTS

| | | | | |
|---|---|---|---|---|
| EP | 2524078 | B1 | 11/2016 | |
| FR | 2853325 | A1 * | 10/2004 | C11D 3/382 |
| GB | 0370105 | A | 4/1932 | |
| GB | 0699794 | | 11/1953 | |
| JP | 2004008740 | A * | 1/2004 | |
| JP | 2007307356 | A * | 11/2007 | |
| JP | 5263794 | B2 * | 8/2013 | |

OTHER PUBLICATIONS

Machine translation of JP-2007307356-A. (Year: 2007).*

Machine translation of JP-2004008740-A. (Year: 2004).*

Electronic translation of FR-2853325-A1 to Eloy et al. (Year: 2004).*

International Search Report for International Application No. PCT/FR2019/051854 dated Oct. 30, 2019, 2 pages.

International Written Opinion for International Application No. PCT/FR2019/051854 dated Oct. 30, 2019, 7 pages.

* cited by examiner

DRUM FOR A WASHING MACHINE, COMPRISING AT LEAST ONE PARALLELEPIPED-SHAPED COMPARTMENT, AND WASHING MACHINE COMPRISING SAME

CROSS-REFERENCE TO RELATED APPLICATIONS

This application is a national phase entry under 35 U.S.C. § 371 of International Patent Application PCT/FR2019/051854, filed Jul. 26, 2019, designating the United States of America and published as International Patent Publication WO 2020/021210 A1 on Jan. 30, 2020, which claims the benefit under Article 8 of the Patent Cooperation Treaty to French Patent Application Serial No. 1856959, filed Jul. 26, 2018.

TECHNICAL FIELD

The present disclosure relates to the specific or derived field of washing mattresses. It relates more particularly to a drum for a washing machine, comprising at least one parallelepiped-shaped compartment, as well as a washing machine or its frame comprising such a drum. The machine of the present disclosure is particularly suitable for robotizing and automating the insertion and/or removal of mattresses in the drum.

Mattresses experience a multitude of attacks throughout their lifetime through all forms of biological soiling, microorganisms and parasites. It therefore appears necessary to maintain them by washing them with some repetition.

Washing your mattress helps to ensure the hygiene of the bedding, sleep comfort and the dynamism of the mattress. This contributes to increasing the lifespan of mattresses, producing a positive impact on the environment and sustainable development.

Currently, most of the existing solutions for treating mattresses consist of simple surface cleaning such as dry cleaning, applying surface disinfectants or vacuum brushing.

However, these techniques do not make it possible to achieve results as compelling as what the mattress washing action in a dedicated machine allows. In fact, unlike surface treatments, washing a mattress in a machine allows the mattress to be washed to its core.

BACKGROUND

In order to meet the need for thorough washing of mattresses, those skilled in the art have turned to washing machines and, in particular, industrial machines offering sufficient volume to wash mattresses. However, due to the weight of the mattresses and their movements in the drum during washing, it is difficult to properly balance the masses in the drum, and an unbalance problem arises causing premature wear of the rotor and the bearing of the drum rotation axis in the short and medium term. In addition, due to the fragility of the materials making up the mattresses, their movements in the drum cause problems of their deterioration.

Patent EP2524078 describes a cylindrical drum that can be used for washing mattresses, comprising various compartments in the form of a circular crown section, making it possible to balance the masses in the drum and thus to limit the unbalance. However, due to the shape of the drum and the compartments, the manual insertion or removal of the mattresses is long and laborious, it requires much handling of the mattress, and it often necessitates the action of several people to successfully insert the mattresses into the different compartments of the drum, in particular, for heavy, thick, flexible or large mattresses such as two-person mattresses.

The many manipulations are physically demanding for the handlers and take time. In addition, when handling soiled mattresses, the health risks for the handlers are increased, in particular, with the risk of pathogenic diseases and microorganisms.

In addition, the use of such machines is associated with low economic profitability, in particular, because of the long time required to load and unload the mattresses therein, as well as the small number of mattresses that can be inserted simultaneously into the drum.

BRIEF SUMMARY

A drum for a washing machine has been developed, comprising at least one parallelepiped-shaped compartment. This shape is particularly advantageous because it greatly facilitates the insertion and the removal of the mattress in the drum. In addition, such a shape makes it possible to automate the insertion and/or removal of the mattresses in the drum, reducing human handling and allowing significant timesavings in the process of washing the mattresses.

The present disclosure makes it possible to have better economic profitability while facilitating and reducing the handling of the mattresses necessary for their insertion into and/or their removal from a washing machine drum. The physical efforts of handling the mattresses by the handling agent are reduced for the following reasons:

- On the one hand, due to the rectangular shape of the compartments, manual insertion and/or removal of the mattresses is greatly facilitated, resulting in a reduction in the physical efforts required to be made for inserting and/or removing the mattresses, and a reduction in the risk of cross-contamination by the mattresses due to less handling;
- On the other hand, this rectangular shape of the compartments of the drum makes it possible to adapt a system for automating the insertion and/or removal of the mattresses to a washing machine comprising such a drum, thus eliminating the physical efforts inherent in the insertion and/or removal of the mattresses, as well as the possible risks of cross-contamination that result therefrom.

In addition to the economic advantage, the present disclosure also has the advantage of:

- handling mattresses of all sizes, in correlation with the market offer for the sale of bedding by manufacturers,
- more practical weight balancing in the drum, and
- preventing falling and/or deterioration of the liquid-filled mattress during the washing or spin-drying action.

DETAILED DESCRIPTION

Figure 1:
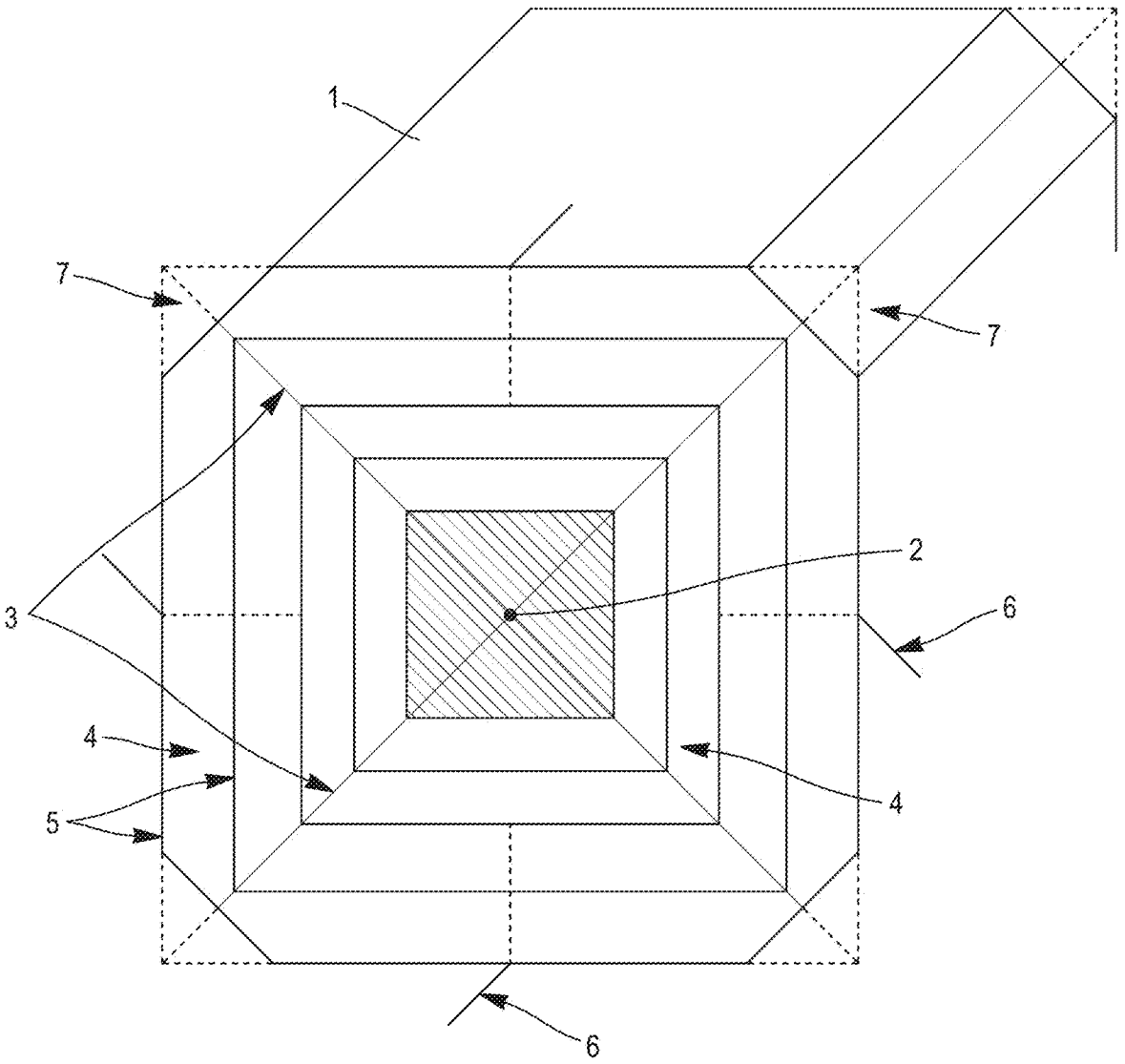
FIG. 1 is a schematic of an embodiment of a drum for a washing machine in the form of a rectangular parallelepiped.

A first object of the present disclosure relates to a drum for a washing machine intended for washing and/or spin drying mattresses, which can rotate about a substantially horizontal axis, comprising at least one parallelepipedal compartment. Preferably, the first object of the present disclosure relates to a drum for a washing machine intended for washing and/or spin drying mattresses, which can rotate about a substantially horizontal axis, which comprises at least one parallelepipedal compartment, which is suitable for containing mattresses.

For the purposes of the present disclosure, the term "washing machine" means a machine suitable for washing and spin drying textiles, including flat linen, duvets, pillows and mattresses. A machine of the present disclosure therefore has the traditional characteristics of a washing machine, in particular, a drum rotating about a substantially horizontal axis, located in a tub capable of containing a liquid suitable for washing textiles. The drum and the tub are made of any material known to those skilled in the art to be strong enough to withstand the forces exerted during washing. Preferably, the drum and the tub are made of stainless steel.

For the purposes of the present disclosure, the term "mattress" means any mattress or object of similar composition (foam, polyurethane, wool, latex, cotton, coconut, and/or springs, etc.) capable of being machine washed, and having a shape substantially similar to that of a mattress. In a non-limiting way, the term "mattress" includes benches, seats and seatbacks, cushions, foam cubes, etc.

Commercial mattresses are generally between 70×140 cm and 200×200 cm, for a thickness between 3 and 40 cm, and a weight ranging from 5 to 70 kg on average.

In the present disclosure, the term "liquid" comprises all liquid compositions that can be used for machine washing. Preferably, the liquid used is water to which washing products can be added.

For the purposes of the present disclosure, the term "parallelepipedal shape" is understood to mean any three-dimensional (3D) geometric shape, the six (6) faces of which are parallelograms. In addition to the conventional parallelepiped shapes, the compartments of the drum of the present disclosure may be in the shape of a particular parallelepiped, in particular, of a cube (six square faces), of a straight block (also known as "rectangular parallelepiped": six rectangular faces) or of a rhombohedron (six diamond faces). Such a shape makes the compartment(s) of the drum particularly suitable for mattresses, since it makes it possible to insert the mattresses into the drum without having to bend them or deform them substantially from their usual common shape. Such a compartment shape therefore facilitates the insertion and removal of the mattress into and from the drum. In particular, a parallelepiped shape makes it possible to automate the process of inserting and/or removing the mattresses.

Preferably, the compartments of the drum of the present disclosure are in the form of a straight block, this shape being the one that best corresponds to the rectangular shape of the mattresses, so as to limit the space lost in the drum and thus the size of the latter. Since this shape of the compartments matches the shape of the mattresses, it thus prevents the deterioration of the water-filled mattresses due to falls occurring during the rotation of the drum, by restricting the movements of the mattresses in the machine. A straight block shape in fact makes it possible to obtain compartments with a shape and dimensions very similar to the mattresses, so that the movements of the mattresses are limited by the compartments.

In a preferred embodiment, the drum comprises at least one compartment, which is dimensioned to limit the movements of the mattresses during the rotation of the drum.

In a preferred embodiment, the drum is also of parallelepiped shape.

The parallelepipedal drum of the present disclosure therefore comprises six faces:

- a front face, located in front of the drum and allowing the insertion of the mattresses of the drum,
- a lower face located under the drum when looking at the front face of the drum,
- an upper face located above the drum when looking at the front face of the drum,
- a rear face located opposite the front face, and
- two side faces, one left and one right, defined as a function of the front face, so that the left side face is the face placed on the left of the front face when looking at the front face of the drum, and in the same way, the right side face is the face placed on the right of the front face when looking at the front face of the drum.

When the drum is of parallelepiped shape, it has twelve edges. The term "edges" is understood to mean the intersections of two faces of the parallelepiped.

Thus, the drum has:

- four upper edges comprising intersections of the upper face with the side faces and the front and rear faces,
- four lower edges comprising intersections of the lower face with the side faces and the front and rear faces, and
- four side edges comprising intersections between:
  - the front face and the left side face,
  - the front face and the right side face,
  - the rear face and the left side face, and
  - the rear face and the right side face.

By extension, it is possible to name each of the edges by the two faces that meet to form the edge. Thus, reference is made, for example, to the upper right edge, formed by the intersection of the upper face and the right side face.

In a particular embodiment, the drum of the present disclosure comprises an open face allowing the insertion and removal of the mattresses from the drum. This face is called the front face of the drum.

In a preferred embodiment, the drum comprises two open faces, one intended for inserting the mattresses into the drum, the other intended for their removal from the drum.

In an even more preferred embodiment, the open faces for inserting and removing the mattresses are located opposite one another. In this preferred embodiment, the face intended for inserting the mattresses is called the front face, and the face intended for removing the mattresses, located opposite the latter, is called the rear face.

A drum with two open faces facing each other is particularly advantageous for companies respecting the RABC method (Risk Analysis Bio-contamination Control) intended to limit the risk of contamination, whereby clean laundry never comes into contact with dirty laundry. This RABC approach is a guarantee of quality and reliability for cleaning/laundry companies; having a drum that meets this approach is therefore essential for such companies. This provision also makes it possible to contribute to improving production management by promoting the forward motion principle.

Like the drums of the prior art, the drum of the present disclosure comprises perforations, allowing water to circulate between the drum and the tub.

The so-called "open" faces, unlike the other faces of the drum, make it possible to insert or remove mattresses in the drum. The other faces of the drum are perforated, so they can let the washing liquid through but they do not let the mattresses through.

The drum of the present disclosure also comprises reinforcements intended to solidify the latter. These reinforcements are made of any material known to those skilled in the art as strong enough to withstand the forces exerted during washing. A mattress can weigh up to 70 kg and a drum spins at least 1000 revolutions per minute during spin drying; it is essential to reinforce the drum to prevent its structure from breaking or deteriorating or degrading over time during washing or spin drying.

For the purposes of the present disclosure, "reinforcement" is understood to refer to means making it possible to reinforce the solidity of the drum. These reinforcements are essential because heavy and bulky mattresses cause significant stresses on the drum during the rotation of the latter. Such means may consist of, for example, rigid rods or plates reinforcing one or more sides of the drum, or passing through the latter from its edges to its center.

In a preferred embodiment, the reinforcements are made of the same material as that of the drum.

The reinforcements of the present disclosure can be perforated to allow the liquid to circulate inside the drum. Good circulation of the liquid in the drum is important because these movements of liquids are one of the bases of the washing action of a washing machine. The perforation of the reinforcements is particularly useful when the reinforcements are rigid plates passing all the way through the drum or plates reinforcing certain faces of the drum, so that the reinforcements do not prevent the circulation of liquid in the drum.

The drum of the present disclosure comprises one or more reinforcements. Preferably, it comprises an even number of reinforcements so as not to unbalance the drum. This even number of reinforcement should then be placed so that the drum is balanced during its rotation.

In a particular embodiment, the present disclosure comprises two reinforcements starting from the central axis, and separating the drum into two equal parts. "Central axis" refers to the axis of rotation of the drum; the central axis can therefore be understood as being the axis of inertia of the drum.

In a preferred embodiment, the reinforcements connect the edges and the central axis, whether it is a physical axis passing through the drum, or a geometric axis.

In a preferred embodiment of the present disclosure, the drum comprises four reinforcements, which connect the edges of the parallelepiped to the central axis. In this embodiment, the reinforcements separate the drum into four identically sized quarters. Separating the drum into four equal quarters facilitates the balancing of the drum, which can be done by filling each quarter of the drum identically. Balancing the masses makes it possible to avoid an unbalance. An unbalance refers to the situation where a mass is not perfectly distributed on the drum, thus leading to an imbalance. The axis of inertia of the drum no longer merges with its axis of rotation.

The unbalance force is a rotating force proportional to the unbalance mass, the unbalance radius and the rotational speed.

Balancing the drum is therefore all the more important in mattress washing machines that are capable of spin drying by spinning, because due to the high speed of rotation of the drum, the unbalance due to the poor distribution of the masses will be amplified.

In a particular embodiment of the present disclosure, the reinforcements consist in reinforcing the edges of the parallelepiped. This reinforcement can be carried out by adding a corner angle on the edge(s) to be reinforced.

For the purposes of the present disclosure, the term "compartments" is intended to mean partitioned spaces in the drum suitable for containing mattresses. A compartmentalization of the drum allows easier weight balancing in the drum and prevents the fall and/or damage of the liquid-filled mattress during the washing or spin-drying action.

The term "compartment suitable for containing mattresses" is understood to mean compartments that are strong enough to be able to support the weight of the mattresses during washing and/or spin drying, and which have dimensions close to the dimensions of the mattresses in order to limit the movements of the mattresses during washing and/or spin drying.

In one embodiment, the drum of the present disclosure comprises at least one compartment suitable for containing a mattress.

In a preferred embodiment, the drum of the present disclosure comprises as many compartments suitable for containing mattresses as there are mattresses to be washed.

In an even more preferred embodiment, the drum of the present disclosure comprises at least two compartments. Preferably, the drum of the present disclosure comprises 2, 3, 4, 5, 6, 7, 8, 9, 10, 11, 12, 13, 14, 15, 16, 17, 18, 19, 20, 21, 22, 23 or 24 compartments.

In a most preferred embodiment, the drum of the present disclosure comprises 8 compartments, which can be separated into 2 if necessary, making it possible to have up to 16 compartments. This separation of the compartments can be carried out using a net, or a perforated plate, to be placed in the compartment in order to separate it into two parts. This embodiment has the advantage on the one hand of allowing a large number of mattresses to be washed at one time, and on the other hand of allowing the drum to be balanced more easily.

In a preferred embodiment of the present disclosure, the compartments of the drum can be separated into two using a polyurethane net. Such a net has the advantage of retaining the mattresses without damaging them, while allowing liquids to pass. This separation makes it possible to divide a compartment suitable for a large mattress (two-person mattress type) into two sub-compartments suitable for each receiving a smaller mattress (one-person mattress type). Therefore, the user has compartments that are always suitable for mattresses in that they have dimensions very close to them, so as to limit their movements during the rotation of the drum.

The compartments of the present disclosure have dimensions chosen to be close to, but greater than, the dimensions of the mattresses to be washed. This choice of dimensions is important in order to limit the movements of the mattresses in the machine. Such movements can be the cause of damage to the mattresses, and can lead to an imbalance of the drum causing the unbalance.

In a particular embodiment of the present disclosure, the compartments have dimensions of the order of 1 centimeter to 1 m greater than the dimensions of the mattress. Preferably, the compartments are between 1 and 50 centimeters more than the dimensions of the mattress. Even more preferably, the dimensions of the compartment are between 1 and 30 centimeters more than the mattress. Most preferably, the dimensions of the compartment are 10 centimeters larger than the dimensions of the mattress.

In a particular embodiment, the compartments suitable for containing mattresses have a length comprised between 141 and 300 cm, preferably a length comprised between 141 and 250 cm, more preferably a length comprised between 141 and 230, most preferably a length comprised between 141 and 210 cm.

In a particular embodiment, the compartments suitable for containing mattresses have a width between 71 and 300 cm, preferably a width between 71 and 250 cm, more preferably a width between 71 and 230, most preferably a width between 71 and 210 cm.

The height of the compartments is particularly important for limiting the movements of the mattresses in the drum.

In a preferred embodiment, the compartments suitable for containing mattresses have a height of between 6 cm and 60 cm, more preferably a height of between 6 and 50 cm, most preferably a height of between 6 and 40 cm.

In a preferred embodiment of the present disclosure, the drum comprises compartments of different sizes, each adapted to a different size of mattress.

The term "partition" refers to the different faces of the parallelepipedal compartment suitable for containing mattresses. The partitions thus delimit the compartment.

The partitions delimiting the compartments of the present disclosure are made of any material known to those skilled in the art as being strong enough to withstand the forces exerted during washing and/or spin drying.

In a preferred embodiment, the partitions are made of the same material as that of the drum. Even more preferably, the partitions are made of stainless steel. In addition, they are perforated in order to allow liquid to circulate inside the different compartments of the drum. Good circulation of the liquid in the drum is important because these movements of liquids are one of the bases of the washing action of a washing machine.

In a particular embodiment, one or more faces of certain compartments may be formed by the wall of the drum or by one or more of the reinforcements of the drum.

In another preferred embodiment, the compartments of the present disclosure are formed by partition elements connecting two successive reinforcements, the partition elements being perforated so as to allow the circulation of liquid.

In a particular embodiment, the drum comprises at least one compartment, which is perforated so as to allow the entry of liquid into the compartment and the exit of liquid from the compartment.

In an alternative embodiment, the compartments are formed by perforated plates, parallel and of the same size as the upper and lower faces, delimiting compartments arranged one above the other, and passing all the way through the drum; the compartments are thus delimited on the sides by the right and left side faces, by the front and rear faces, respectively, in front and behind, and in its height either by one of the upper or lower faces and one of the perforated plates, or by two successive perforated plates.

In a preferred embodiment, the drum comprises at least one door allowing access to the drum for loading, and also making it possible to prevent the mattresses from leaving their compartments during the washing and/or spin-drying action.

The door is therefore located at the front of the drum, allowing the insertion of the mattresses into the drum.

In an embodiment comprising two open faces facing each other, the term "at least one door" designates at least one pair of doors distributed evenly between the open faces. Thus, "at least one door" here refers to a door on the front face allowing the insertion of the mattresses, and a door on the rear face allowing the removal of the mattresses.

A door of the present disclosure corresponds to a solid or perforated surface, which can comprise an automated and secure opening system, or which can be used manually, and having rapid and secure locking.

In an even more preferred embodiment, the drum is composed of 4 quarters each having a door for the entry and a second door opposite it for the exit of the mattresses from the drum. Thus, the drum in this embodiment has 4 doors on its front face and 4 doors on its rear face, each door allowing access to a quarter of the drum.

In a particular embodiment, the drum comprises blades, located on the outer face of the drum. These blades make it possible, when the drum is rotating in the machine, to infuse movement into the liquid contained in the tub, so as to maximize the movements of liquid at the origin of the washing action and therefore to improve the washing quality and time.

In a particular embodiment, the drum comprises at least two blades. Preferably, the drum comprises a number of blades corresponding to a multiple of 4, in order to have the same number on each face of the drum. Even more preferably, the drum comprises 4, 8, 12 or 16 blades. Most preferably, the drum comprises 4 blades.

The blades are spaced from the outer face of the drum at an angle of between 1 and 90°. Preferably, the blades are separated from the outer face by an angle of between 30 and 60°. Even more preferably, the blades are separated from the outer face by an angle of 45°.

In a particular embodiment, the drum of the present disclosure is truncated at its ends so as to reduce its bulk. A reduction in the volume of the drum makes it possible to reduce its size and weight, and thus the energy cost necessary for the correct operation of the machine.

Preferably, the truncation has a triangular prism shape, removed from each edge of the drum. Such truncation makes it possible to reduce the length of the diagonals of the drum, making it possible to reduce the size of the tub containing it, and therefore to reduce the size of the machine comprising such a drum.

In a particular embodiment of the present disclosure, the drum is removable.

A removable drum refers to a drum that can be inserted into and removed from a washing machine tub. Such a drum has several advantages:

- On the one hand, it is easier to load; it can be placed, in particular, near the device for inserting/removing the mattresses if it is in the room, unlike the non-removable drums, which require a mattress insertion/removal device, which is attached to the washing machine.
- On the other hand, this also makes it possible to have several drums for the same machine. Thus, it is then possible to have specific drums each of a different mattress size, and to insert the drum that best corresponds to the mattresses to be washed on the machine. Likewise, having several removable drums allows users to load one or more drums in advance, in order to be able to accelerate the washing rate by just having to change the drum between two successive washes.

In an even more particular embodiment of the present disclosure, the drum of the present disclosure is compressible.

Such a drum can be compressed by pressure from its upper face toward its lower face, in order to spin dry the mattresses. A compressible drum of the present disclosure comprises rails at its four lateral edges making it possible to slide the perforated plates parallel to the upper and lower faces defining the compartments of the drum, so as to reduce the height of the compartments, and thus compress the mattresses placed in each of the compartments.

In a very particular embodiment of the present disclosure, the drum is removable and compressible. It can thus be compressed either inside the washing machine or outside it.

In a particular embodiment, the drum comprises doors, making it possible to close the front and rear faces, so that the mattresses are locked inside the drum, and do not come out of the latter. These doors prevent the mattresses from moving between the drum and the tub door, which can damage the ends of the mattresses.

A second object of the present disclosure relates to a washing machine comprising a drum of the present disclosure.

In the present disclosure, the term "washing machine" comprises both the machine and its frame.

A machine of the present disclosure is a machine suitable for washing and spin drying mattresses. It incorporating the traditional characteristics of an industrial washing machine, in particular, a drum rotating about a substantially horizontal axis, located in a tub capable of containing liquid.

For the purposes of the present disclosure, the term "frame" refers to a rigid framework serving as a support for the other elements.

A washing machine of the present disclosure comprises a sealed tub suitable for containing the liquids used for washing mattresses.

The tub is intended to accommodate a drum of the present disclosure. This means that it is of sufficient size to contain a drum of the present disclosure, and that it is strong enough to withstand the movements of liquids caused by the rotation of the drum in the tub.

In a particular embodiment, the present disclosure relates to a washing machine comprising a tub in which the drum is removably mounted so as to allow its insertion into the tub and its removal from the tub.

In a particular embodiment, the tub is intended to accommodate a removable drum according to one embodiment. Such a tub must then have a system allowing the attachment of the removable drum.

In a particular embodiment of the present disclosure, the parallelepipedal drum is held by one or more rings interconnected by connecting rails also serving to guide and hold the parallelepipedal drum. These rings serve as tracks for rolling and driving the parallelepipedal drum. The fixing system is composed of two metal rings in which four parallel metal rails are fixed, which are placed so that each one accommodates one of the edges of the removable drum of the present disclosure, so that the drum is found inscribed in each of the rings.

The fixing system will be better understood on reading the examples.

The fixing system is rotated by drive means. Such drive means can be, for example, a direct gear system, drive rollers, direct or offset drive chain, or belt, with one or more direct or offset drive motors.

In an even more particular embodiment, the drum of the present disclosure is placed in a circular tub with a diameter equal to the diagonal of the drum. The tub, and the drum attached to it, will be set in motion by drive means such as those described above; this embodiment has the advantage of consuming less water and requiring fewer materials for its construction than traditional machines with a rectangular tub.

In a particular embodiment, the tub is cylindrical, or quasicylindrical, or preferably barrel-shaped.

A third object of the present disclosure relates to a device comprising a washing machine comprising a drum of the present disclosure and a system for automating the insertion of the mattresses into the drum of the washing machine.

Such a system for automating the insertion of the mattresses into the drum of the machine consists of an insertion structure and, optionally, the automation system may also comprise:

a ground or aerial conveying zone, a buffer zone, and an unloading zone.

In a preferred embodiment of the present disclosure, the drum of the machine is removable, so that it is removed from the mattress washing machine, then placed, manually or not, in front of the automation system of the present disclosure. This embodiment has the advantage of being more functional in that it does not require the automation system to be located directly in front of the mattress washing machine, which is more profitable because it makes it possible to improve the insertion or removal time of the mattresses in the washing machine, and more adaptable because it can have several removable drums available with compartment dimensions adapted to the characteristics or constraints of the washed mattresses.

The insertion structure of the present disclosure corresponds to a structure consisting of different levels of ball bearing plates. Each level of the structure contains the mattress or mattresses to be inserted into a compartment of the drum of the present disclosure. The number of levels of the structure generally corresponds to the number of compartments in the drum. This insertion device allows the simultaneous insertion of all the mattresses present in the structure, resulting in a significant saving of time compared to manual insertion of the mattresses.

In a preferred embodiment of the drum of the present disclosure, the latter is divided into four quarters by the reinforcements of the drum. In this preferred embodiment, the insertion structure comprises as many levels as there are compartments present in a quarter of the drum, so as to insert, in the same operation, all the mattresses present in the insertion structure in a quarter of the drum.

In an even more preferred embodiment, the insertion structure is precisely adapted to the shape and number of compartments of the drum; i.e., in a most preferred embodiment, 8 compartments.

A "ball bearing plate" of the present disclosure corresponds to a plate comprising a multitude of balls intended to allow easy movement of the mattresses in all directions. Such a plate is known to those skilled in the art working in handling; the balls composing it are sometimes called conveying balls or carrier balls.

In a preferred embodiment, the automation system comprises a pusher and/or at least two rollers.

In a preferred embodiment, the device comprises, facing a compartment of the drum, at least one pusher on an actuator making it possible to push a mattress in the direction of the drum, and at least two rollers (15) guiding the mattress, which are located between the pusher and the drum.

Each level of the insertion structure comprises:

On its front face, located opposite a compartment of the drum, at least two rollers intended to grip and guide the mattresses.

On its rear face, at least one pusher (or pushing element) on an actuator making it possible to push the mattresses in the direction of the drum.

The rollers of the present disclosure are located opposite the upper and lower ends of the drum compartment. Their role is to grip the mattress to direct the mattress and facilitate its insertion into the compartment when it is pushed. They can be free or motorized.

In a preferred embodiment, the rollers are motorized so that their rotation facilitates movement of the mattress.

In an even more preferred embodiment, the rollers have a hooking system in order to better grip the mattress and to allow traction of the mattress by the rollers, equivalent to and simultaneous with the thrust effected by the pusher. This combined action of pulling and pushing makes it possible to avoid the deformations of the mattress, which may occur if the back of the mattress, in contact with the pusher, is pushed faster than the rest of the mattress moves.

The term "hooking system" refers to a roller having a structure comprising elements in relief allowing better grip on the mattress. Such a roller includes, without limitation, the rollers comprising notches, teeth, crampons, brushes, picks, nails, etc.

In a particular embodiment of the present disclosure, the hooking system of the present disclosure can be a suction system using suction to hook the mattress in order to allow the mattress to be pulled.

An actuator refers to a part intended to create a mechanical movement. The actuator may be of the hydraulic, or pneumatic or electric type, or of any other type known to those skilled in the art.

In a preferred embodiment of the present disclosure, the actuator performs a translational movement in the direction of the drum, so as to be able to push the mattresses inside the latter.

The pusher of the present disclosure is a part intended to transmit the thrust supplied by the actuator. It can be formed by anything that can push a mattress. In a nonlimiting manner, a pusher of the present disclosure can be: one or more flat surface(s), one or more rods, etc.

In a preferred embodiment of the present disclosure, the pusher is formed by a horizontal plate, approximately the size of the smallest side of the mattress, in order to be able to push the latter into the drum of the present disclosure.

Thus, the mattress located on the ball bearing plate is pushed by the movement of the actuator through the rollers until the latter fully penetrates into the drum compartment located opposite the rollers.

In a preferred version of the present disclosure, each level of the structure comprises at least two rollers and at least one pusher, which will push the mattresses of each level into their respective compartments in the drum at the same time.

The different levels of the insertion structure can be loaded manually; it is enough for the handler(s) to place the mattress on the ball bearing plate and to align it by sliding it on the ball bearing plate.

In a particular embodiment, the different levels of the insertion structure are loaded automatically.

This automatic insertion is carried out either from conveyors or from a buffer zone allowing the simultaneous loading of all the levels of the insertion zone.

The conveying zone of the present disclosure corresponds to a module intended to convey the mattresses one by one to the insertion structure or to the "buffer" zone. It comprises any type of conveyor known to those skilled in the art, such as a belt conveyor or a roller conveyor. Preferably, the conveyor(s) are motorized.

The buffer zone of the present disclosure corresponds to a zone intended to store the mattresses with a view to their loading in the insertion zone. This zone corresponds to a structure made up of a number of levels of conveyors equal to the number of levels present in the insertion structure. The main advantage of this zone is to reduce the total insertion time into the drum, by preparing the mattresses intended to be inserted into the drum while mattresses are being inserted.

In a preferred embodiment in which the drum comprises several quarters, the buffer zone allows the preparation of the mattresses intended to be inserted in one quarter of the drum while others are being inserted in another quarter.

In an alternative embodiment, the automation system comprises several buffer zones for storing the mattresses in order to load them into the insertion zone. The presence of several buffer zones further reduces the total insertion time into the drum.

In a preferred embodiment of the present disclosure, the conveyors of the buffer zone are motorized.

In another preferred embodiment, the structure of the buffer zone comprises a system for varying the height of the latter. Such a system can be, in particular, composed of actuators. The variation in height of the structure makes it possible to reduce the forces to be provided to the handlers in order to place the mattresses in the buffer zone.

In an alternative version of this embodiment, the device also comprises a system of conveyors. The height variation system thus makes it possible to load the various plates of the buffer zone from the conveyor by adapting the height of the structure so that each plate of the latter can be placed in turn on the side of the conveyor, in order to load a mattress there.

The unloading zone of the present disclosure corresponds to a zone consisting of a ball bearing and/or roller plate, making it possible to place the mattresses in the automation device. The mattresses are taken out of trucks or any other goods transport vehicle or brought from transport carts, then deposited one by one, either manually or by a machine, on the ball bearing and/or roller plate. The ball bearing plate makes it possible to orient all the mattresses effortlessly in the same direction before sending them onto the conveyor. The rollers make it easier to guide the mattresses in the desired direction.

In a preferred embodiment of the device, the latter comprises an insertion structure, a buffer zone, conveyors and an unloading zone.

In alternative embodiments, the device comprises an insertion structure and one or more modules chosen from: one or more buffer zones, one or more conveyors, or one or more unloading zones.

In the alternative embodiments not comprising a buffer zone, the structure of the insertion zone comprises a system making it possible to vary the height of the latter. Such a system can be, in particular, composed of actuators. The variation in height of the structure makes it possible to reduce the forces to be provided to the handlers in order to place the mattresses in the insertion zone.

In an alternative version of this embodiment comprising a conveyor, the height variation system makes it possible to load the different plates of the insertion zone from the conveyor by adapting the height of the structure so that each plate of the latter can be placed in turn on the side of the conveyor, in order to load a mattress.

EXAMPLES OF IMPLEMENTATION

1st Embodiment: FIG. 1

The drum (1) for a washing machine is in the form of a rectangular parallelepiped, the edges (7) of which are truncated lengthwise. It can rotate about an axis (2).

The drum (1) comprises perforated reinforcements (3) delimiting 4 quarters in the drum.

Each quarter comprises 4 compartments (4) delimited by the reinforcements (3) and the partition elements (5).

The drum also comprises 4 blades (6), each passing through the outside of the faces in the length direction, the blades being spaced from the face by an angle of 45°.

Figure 2:
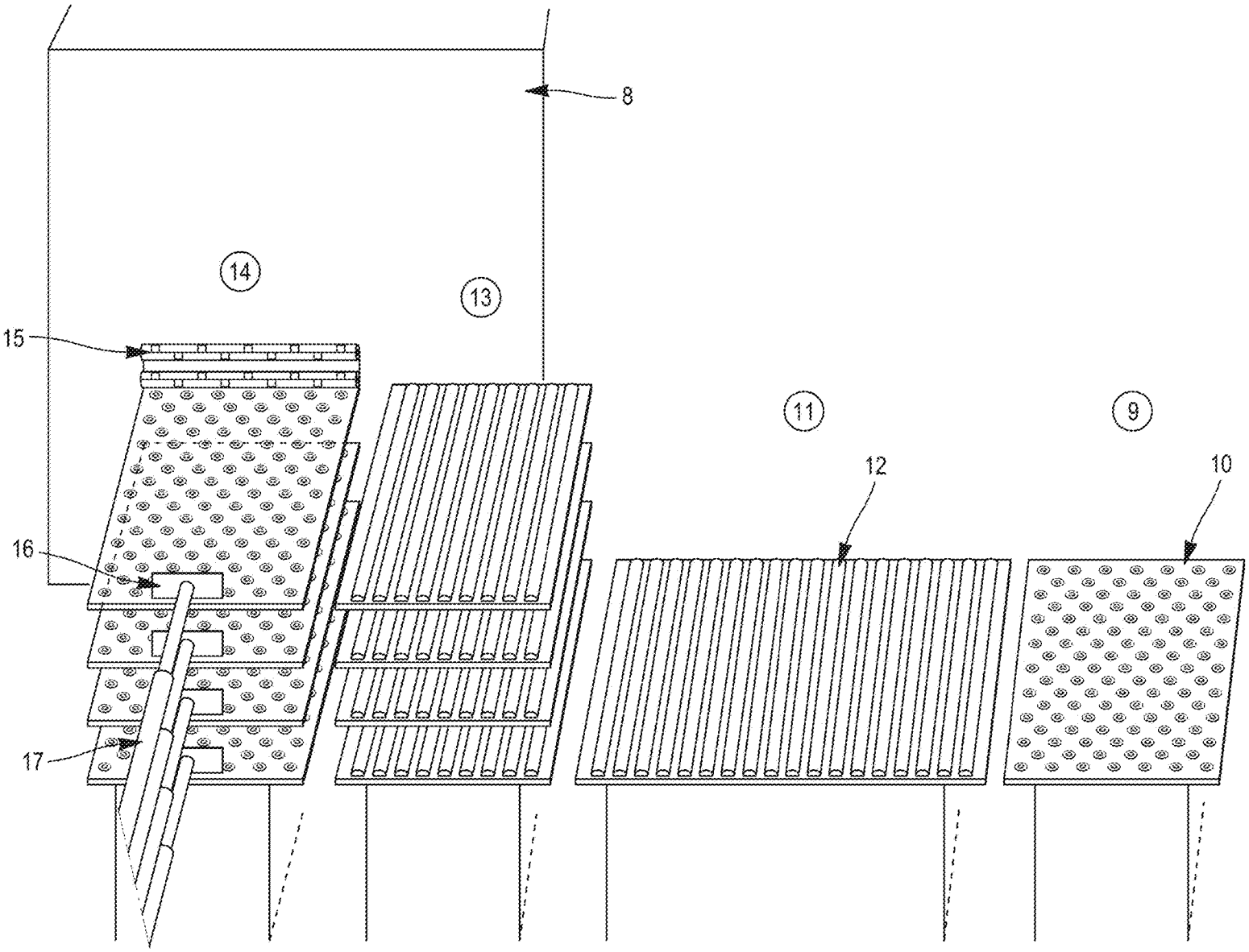
FIG. 2 illustrates components for an embodiment of an automated system for inserting the mattresses into a washing machine.

Automation System: FIG. 2

The device of the present disclosure may include a mattress-washing machine (8) comprising a drum of FIG. 1 and an automated system for inserting the mattresses into the machine.

The insertion system comprises:

- a loading zone (9) made up of ball bearing plates (10),
- a conveying zone (11) consisting of a roller conveyor (12) connecting the loading zone to the buffer zone,
- a buffer zone (13) with 4 levels with automated roller plates on each level, and
- a 4-level insertion zone (14) comprising ball bearing plates on each level, the ball bearing plates being aligned with the 4 compartments of the drum of the present disclosure. Each level comprises, located flush with its respective drum compartment, two spiked rollers (15), and a pusher system (16) comprising an actuator (17).

The mattress is loaded flat on the insertion zone, where it will be oriented thanks to the ball bearing plate. The mattress is oriented so that its length is perpendicular to the direction of the conveyor rollers. The mattress will then advance along the conveyor until it passes over one of the plates of the buffer zone placed on the side of the conveyor.

As one mattress advances on the conveyor, another is placed over the insertion zone and so on.

When a mattress is loaded into the buffer zone, the actuators (17) will vary the height of the structure in order to match an empty level of the structure with the end of the conveyor, so that the next mattress placed on the conveyor passes over the buffer zone plateau. Such an operation will be repeated until the 4 levels of the buffer zone are filled.

The buffer zone is then aligned with the insertion zone, so that the 4 levels of the buffer zone each comprising a mattress are aligned with a ball bearing plate level of the insertion zone. The rollers of the 4 levels will be activated, in order to move the 4 mattresses simultaneously in the insertion zone.

The mattresses located on the 4 ball bearing plates of the insertion zone will be pushed toward their respective compartments in the drum by pushers (16) on actuators. When they arrive at the end of the ball bearing plate, they are clamped by two spiked rollers (15), which, by their rotation, will contribute to the displacement of the mattresses toward the compartments of the drum, while limiting the deformations due to the pressure of the actuators.

During the step of inserting the mattresses into the drum, other mattresses are conveyed into the buffer zone via the conveyor.

When the insertion of the mattresses is finished, the actuators will move back to their initial position; at the same time, the machine drum will rotate in order to present an empty quarter facing the insertion zone.

The previous steps will then be repeated, starting from the simultaneous movement of the 4 mattresses from the buffer zone to the insertion zone, until all four quarters of the drum are loaded.

Figure 3:
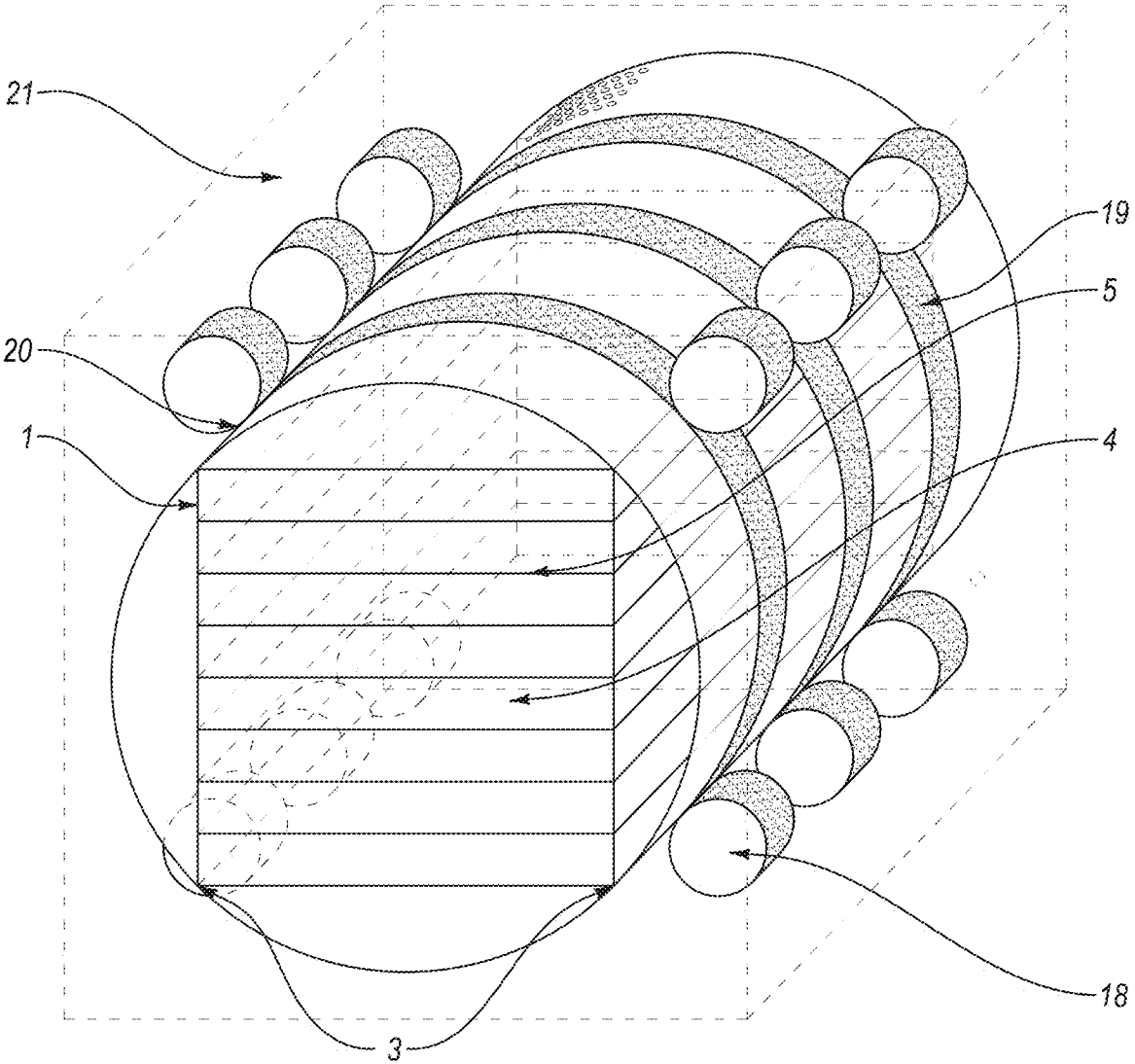
FIG. 3 illustrates an embodiment of removable washing machine drum that includes superimposed compartments formed by partitions.

Second Embodiment: FIG. 3

The washing machine drum (1) is in the form of a rectangular parallelepiped. It is removable for insertion as well as removal. It is rotated using drive rollers (18) located on three outer rings (19) forming treads. The rings (19) are connected by four through slides (20) holding the drum during its rotation and serving to guide the latter during its insertion and its removal in order to facilitate the latter.

The assembly is integrated into a tub (21) comprising two opposite doors (not shown) supported by pillars forming the entire washing machine.

The drum (1) comprises perforated walls as well as reinforcements (3) at its edges, as well as doors, making it possible to close the drum to prevent the mattresses from leaving the drum.

The drum comprises compartments (4) formed by partitions (5) and superimposed, having the shape of a rectangular parallelepiped.

The drum is compressible. For this, it comprises rails at its lateral edges, allowing the walls of the compartments to slide in the direction of the underside of the drum.

Figure 4:
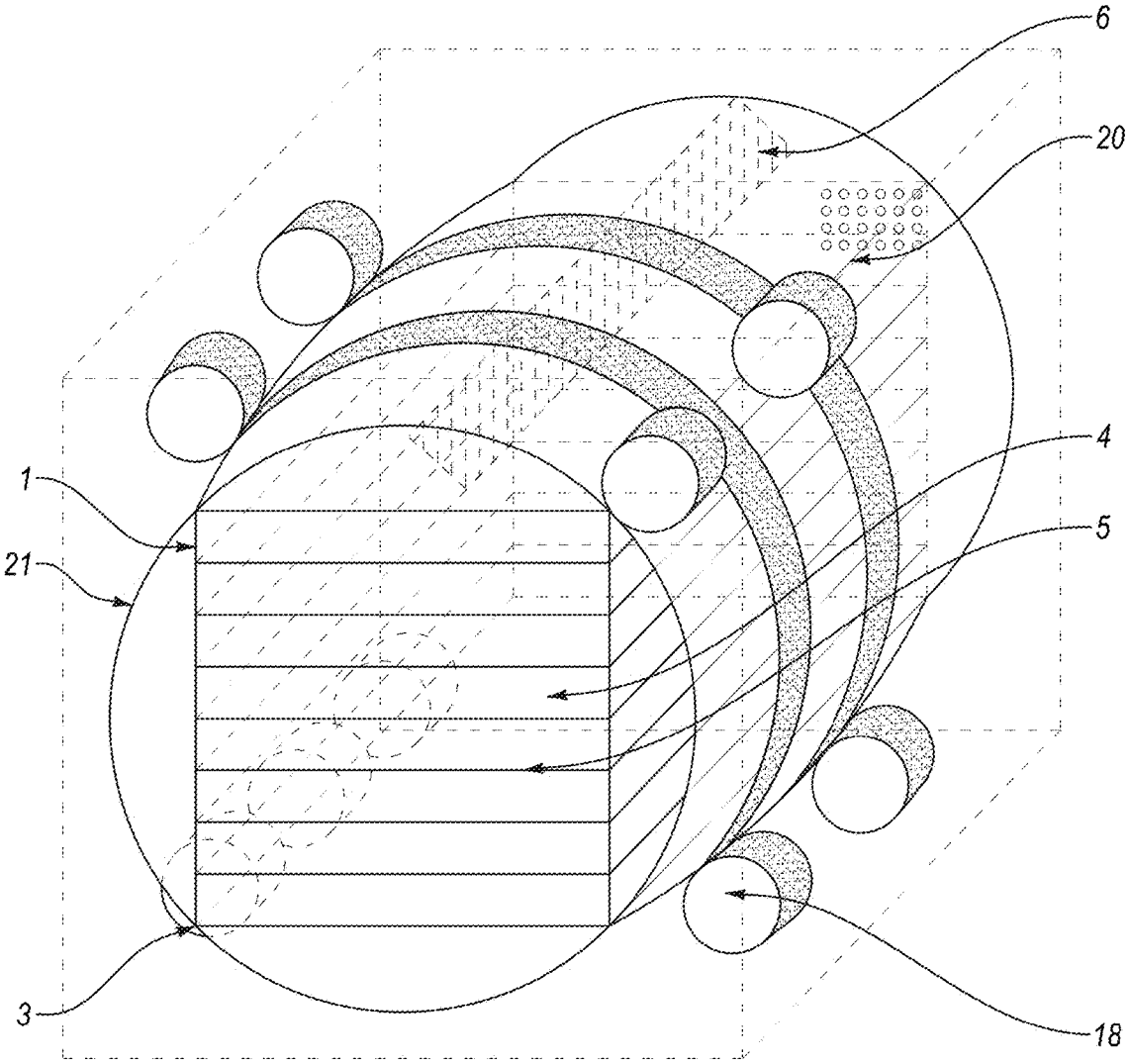
FIG. 4 illustrates an embodiment of a removable washing machine drum that includes four parallel through slides to facilitate the insertion into and removal from the washing machine tub.

Third Embodiment: FIG. 4

The washing machine drum (1) is in the form of a rectangular parallelepiped. It is removable for insertion as well as removal. The drum is inserted into a cylindrical or quasicylindrical tub (21), by means of four parallel through slides (20), each accommodating one of the edges of the drum, so as to maintain it during its rotation, but also to facilitate its insertion into and its removal from the tub.

The tub is rotated using drive rollers (18) located on the outside of the tub.

The drum (1) comprises perforated walls as well as reinforcements (3) at its edges.

The drum comprises compartments (4) formed by partitions (5) and superimposed, having the shape of a rectangular parallelepiped.

The drum is compressible. For this, it comprises rails at its lateral edges, allowing the walls of the compartments to slide in the direction of the underside of the drum.

Said drum also comprises 4 blades (6), each passing through the outside of the faces in the length direction, the blades being spaced from the face by an angle of 45°.

Figure 5B:
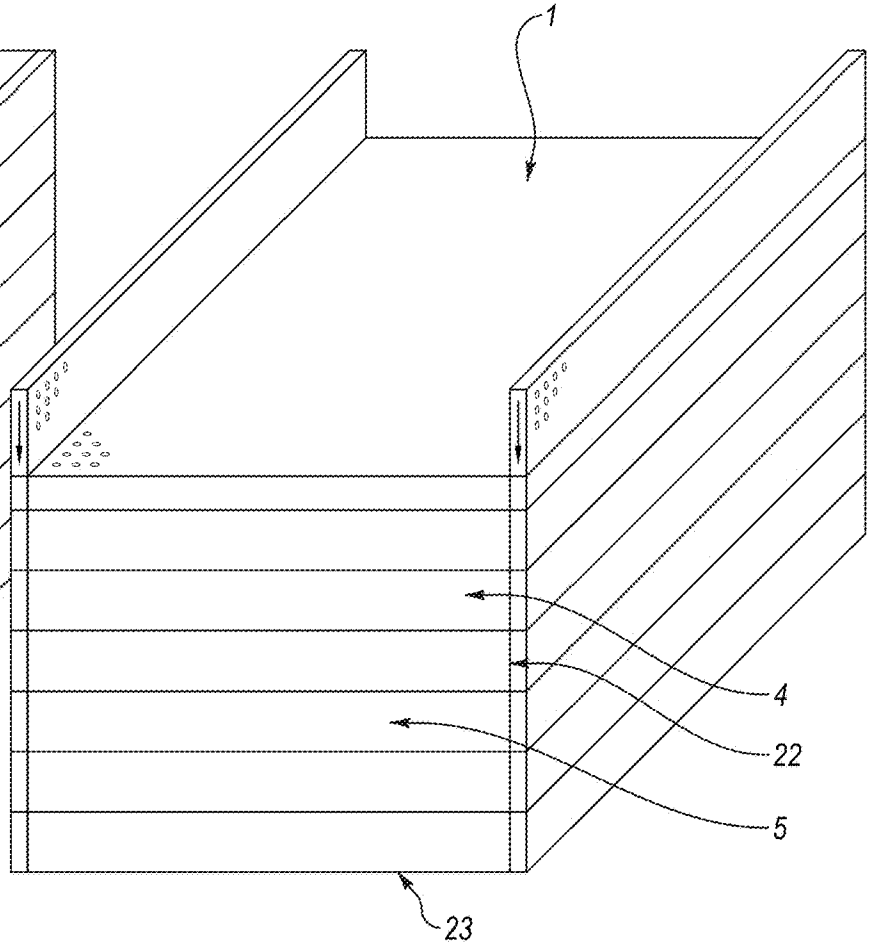
FIG. 5B illustrates the embodiment of the washing machine of FIG. 5A in a compressed state.
Figure 5A:
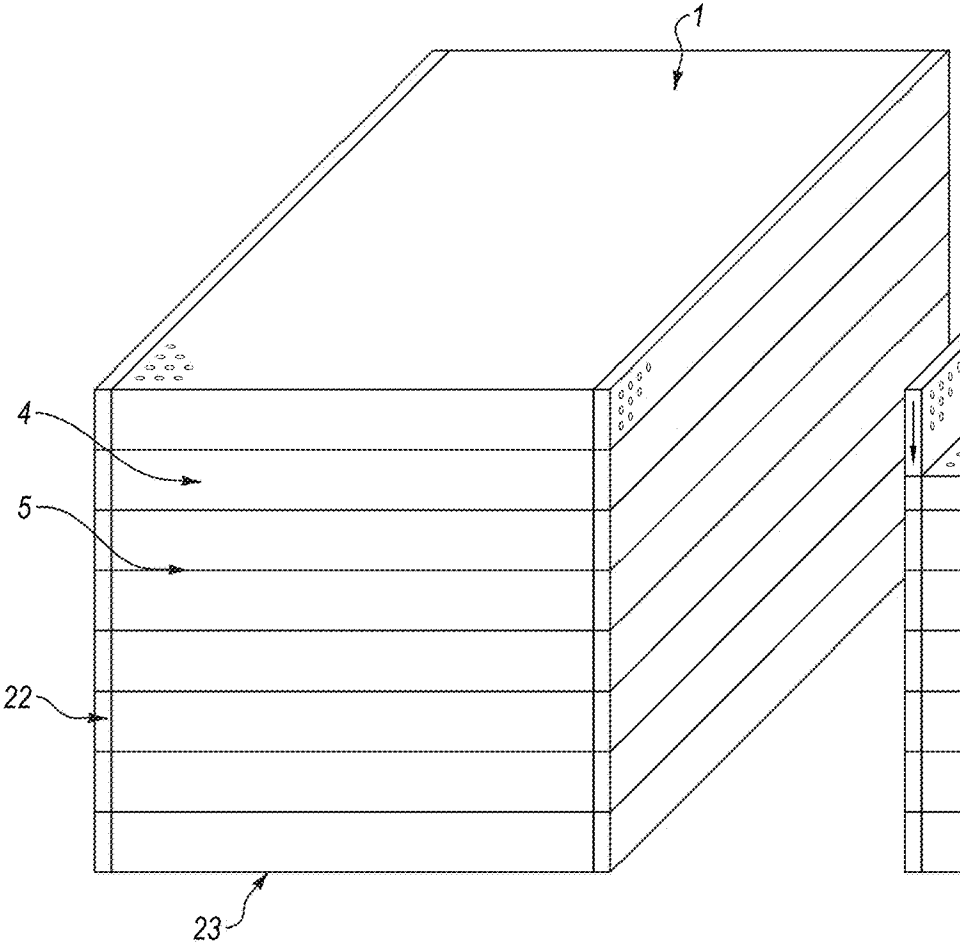
FIG. 5A illustrates an embodiment of a washing machine drum in an uncompressed state.

FIG. 5A and FIG. 5*b* Drum in Uncompressed State (5A) and in Compressed State (5B)

The drum comprises rails (22) at its lateral edges, allowing the partitions (5) of the compartments (4) to slide toward the underside of the drum (23).

FIG. 5B shows the drum when a force is exerted on its upper face, toward the lower face. The upper and lower walls of the compartments will then slide along the rails (22) toward the lower face, resulting in a reduction in the height of the compartments.

The drum comprises compartments (4) formed by partitions (5) and superimposed, having the shape of a rectangular parallelepiped.

The drum is compressible. For this, it comprises rails at its lateral edges, allowing the walls of the compartments to slide in the direction of the underside of the drum.

Said drum also comprises 4 blades (6), each passing through the outside of the faces in the length direction, the blades being spaced from the face by an angle of 45°.

FIG. 5A and FIG. 5B drum in uncompressed state (5A) and in compressed state (5B)

The drum comprises rails (22) at its lateral edges, allowing the partitions (5) of the compartments (4) to slide toward the underside of the drum (23).

FIG. 5B shows the drum when a force is exerted on its upper face, toward the lower face. The upper and lower walls of the compartments will then slide along the rails (22) toward the lower face, resulting in a reduction in the height of the compartments.

The invention claimed is:

1. A drum for a washing machine configured for washing and/or spin drying mattresses, the drum having a parallelepipedal shape and being configured to rotate about a substantially horizontal axis, the drum comprising a plurality of superimposed parallelepipedal compartments each configured to contain one or more unbent mattresses therein, the one or more unbent mattresses having length and width dimensions between 70×140 cm and 200×200 cm, respectively, and a thickness between 3 and 40 cm, the one or more unbent mattresses further comprising a weight ranging from 5 to 70 kg, the drum comprising an open face, the open face allowing the insertion and removal of the one or more unbent mattresses from the drum, the open face being located at an axial end of the drum and the substantially horizontal axis passing through the open face, the drum having a means for driving the drum arranged around a periphery of the drum.

2. The drum of claim 1, wherein the at least one parallelepipedal compartment has dimensions that match the dimensions of the one or more unbent mattresses so as to substantially limit the one or more unbent mattresses from moving during the rotation of the drum.

3. The drum of claim 2, wherein the at least one parallelepipedal compartment is perforated so as to allow the entry of liquid into the compartment and the exit of liquid from the compartment.

4. The drum of claim 1, wherein the at least one parallelepipedal compartment is perforated so as to allow the entry of liquid into the compartment and the exit of liquid from the compartment.

5. The drum of claim 4, wherein the parallelepipedal compartment comprises at least one partition, the at least one partition comprising stainless steel.

6. The drum of claim 1, wherein the drum is compressible.

7. The drum of claim 1, wherein the drum comprises two open faces, one open face of the two open faces configured for inserting the one or more unbent mattresses into the drum, the other face of the two open faces configured for removal of the one or more unbent mattresses from the drum.

8. The drum of claim 1, wherein the drum comprises reinforcements.

9. The drum of claim 8, wherein the reinforcements are perforated.

10. The drum of claim 1, wherein the drum comprises a plurality of rails, each rail of the plurality of rails being positioned at a lateral edge of the drum.

11. The drum of claim 10, wherein the drum is compressible by sliding at least one parallelepipedal compartment of the plurality of superimposed parallelepipedal compartments along the plurality of rails to reduce an overall height of the plurality of superimposed parallelepipedal compartments.

12. A washing machine comprising a drum having a parallelepipedal shape and being configured for washing and/or spin drying mattresses, the drum configured to rotate about a substantially horizontal axis, the drum comprising a plurality of superimposed parallelepipedal compartments each configured to contain one or more unbent mattresses therein, the one or more unbent mattresses having length and width dimensions between 70×140 cm and 200×200 cm, respectively, and a thickness between 3 and 40 cm, the one or more unbent mattresses further comprising a weight ranging from 5 to 70 kg, the drum comprising an open face, the open face allowing the insertion and removal of the one or more unbent mattresses from the drum, the open face being located at an axial end of the drum and the substantially horizontal axis passing through the open face, the drum having a means for driving the drum arranged around a periphery of the drum.

13. The washing machine of claim 12, further comprising a tub in which the drum is removably mounted so as to allow insertion of the drum into the tub and removal of the drum from the tub.

14. The washing machine of claim 12, further comprising an automatic system for automatically inserting the one or more unbent mattresses into the drum of the washing machine.

15. The drum of claim 14, wherein the automatic system comprises, facing a compartment of the drum, at least one pusher on an actuator making it possible to push a mattress of the one or more mattresses in the direction of the drum.

16. The drum of claim 14, wherein the automatic system comprises at least two rollers configured for guiding a mattress of the one or more mattresses in the direction of the drum.

17. A washing machine comprising:

a drum configured for washing and/or spin drying mattresses, the drum configured to rotate about a substantially horizontal axis, the drum comprising at least one parallelepipedal compartment configured to contain one or more mattresses therein, the one or more mattresses having length and width dimensions between 70×140 cm and 200×200 cm, respectively, and a thickness between 3 and 40 cm, the one or more mattresses further comprising a weight ranging from 5 to 70 kg, the drum comprising an open face, the open face allowing the insertion and removal of the one or more mattresses from the drum, the open face being located at an axial end of the drum, the drum having a means for driving the drum arranged around a periphery of the drum; and an automatic system for automatically inserting the one or more mattresses into the drum of the washing machine;

wherein the automatic system comprises, facing a compartment of the drum, at least one pusher on an actuator making it possible to push a mattress of the one or more mattresses in the direction of the drum and at least two rollers guiding the mattress of the one or more mattresses, the at least two rollers located between the pusher and the drum.

18. The washing machine of claim 17, wherein the drum is of parallelepipedal shape.

* * * * *